US005462023A

United States Patent [19]

Furuya

[11] Patent Number: 5,462,023

[45] Date of Patent: Oct. 31, 1995

[54] RAIN COVER OF AN IGNITION PLUG ATTACHING HOLE

[75] Inventor: Yoshinobu Furuya, Shizuoka, Japan

[73] Assignee: Yazaki Corporation, Tokyo, Japan

[21] Appl. No.: 321,919

[22] Filed: Oct. 12, 1994

[30] Foreign Application Priority Data

Oct. 13, 1993 [JP] Japan ..... 5-060002 U

[51] Int. Cl.[6] ..... H01T 13/06

[52] U.S. Cl. ..... 123/143 C

[58] Field of Search ..... 123/143 C, 169 PA, 123/169 PH; 439/125, 127

[56] References Cited

U.S. PATENT DOCUMENTS 5,377,640 1/1995 Kobayashi ..... 123/143 C

FOREIGN PATENT DOCUMENTS 61-61779 4/1986 Japan .
63-35268 3/1988 Japan .

*Primary Examiner*—Tony M. Argenbright
*Attorney, Agent, or Firm*—Sughrue, Mion, Zinn, Macpeak & Seas

[57] ABSTRACT

The present invention prevents drops of water from entering an ignition plug attaching hole through a vent hole formed for communicating an inner space of the ignition plug attaching hole with the atmosphere. A rain cover of an ignition plug attaching hole includes a cylindrical portion engaged in an ignition plug attaching hole formed in an engine head, the cylindrical portion liquid-tightly sealing the ignition plug attaching hole. A vent hole is formed in the cylindrical portion for communicating a space formed in the ignition plug attaching hole with the atmosphere. A flange portion is perpendicularly provided to the cylindrical portion so that the flange portion comes into contact with an outer surface of the engine head. A wall surface is perpendicularly provided on a surface of the cylindrical portion on the atmosphere side; the wall surface is opposed to a surface of the flange portion on the atmosphere side and extends in a radial direction perpendicular to an axis of the ignition plug attaching hole. An opening of the vent hole on the atmosphere side is closely disposed facing the wall surface.

9 Claims, 4 Drawing Sheets

RAIN COVER OF AN IGNITION PLUG ATTACHING HOLE

BACKGROUND OF THE INVENTION

1. Field of the Invention

The present invention relates to a rain cover attached to an ignition plug attaching hole formed in an engine head of an automobile engine for the purpose of preventing drops of water from entering the ignition plug attaching hole. More particularly, the present invention relates to an improved rain cover of an ignition plug attaching hole by which drops of water do not enter the ignition plug attaching hole through a vent hole formed through the rain cover and communicating a space inside the ignition plug attaching hole with the atmosphere.

2. Description of the Related Art

Conventionally, a plug cap is used for connecting a high tension cable for supplying a high voltage current to an ignition plug of an automobile. In this connection, in the case of a Dual Over-Head Cam (DOHC) engine having two cam shafts for opening and closing the valves on the engine head, the ignition plug is attached at a bottom portion of the ignition plug attaching hole provided on the engine head.

Accordingly, a plug cap used for the DOHC engine is formed long and slender, so that the high tension cable can be connected with the ignition plug attached at the bottom of the ignition plug attaching hole. A rain cover, liquid-tightly engaged in the ignition plug attaching hole, is provided so that drops of rain water do not enter the ignition plug attaching hole.

FIG. 3 is a view showing an example of the plug cap for use in the DOHC engine described above. This plug cap 5 includes: a high tension cable 21; a long and slender cylindrical insulator 20 accommodating a connection terminal 22 for connecting the high tension cable with an ignition plug 3; and a rain cover 10 attached at an end of this insulator 20 for liquid-tightly sealing the ignition plug attaching hole 2. This plug cap 5 is attached to an engine head 1.

As shown in FIG. 4, the rain cover 10 is externally engaged with the insulator 20. The rain cover 10 includes: a cylindrical portion 11, the lower end of which is engaged with an inner circumferential surface of the ignition plug attaching hole 2; a disk-shaped flange portion 13 having a contact portion 14 concentrically provided on an outer circumferential surface of the cylindrical portion 11 so that the contact portion 14 comes into contact with an outer surface of the engine head 1; and a protrusion 12 protruding outward from a head of the cylindrical portion 11 in a radial direction with respect to an axis of the ignition plug attaching hole 2.

A cutout portion 15 is formed on a surface of the cylindrical portion 11 at a base end of this protrusion 12. An opening of the vent hole 16 on the atmosphere side faces this cutout portion 15 so that an inner space of the ignition plug attaching hole can be communicated with the atmosphere. Because of the above construction, even when air in the ignition plug attaching hole 2 is expanded by the heat of an engine, the plug cap 5 is not disengaged from the ignition plug attaching hole 2 by the pressure of expanded air, so that the plug cap 5 is not disconnected.

Although the conventional rain cover 10 possesses a profile having an excellent appearance and a high workability of attaching the plug cap 5 to the engine, the following problems may be encountered.

As shown in FIG. 4, an amount of protrusion of the protruding portion 12 covering the cutout portion 15 facing the opening of the vent hole 16 on the atmosphere side is small, and an outer end portion of this protruding portion 12 is connected with the cutout portion 15 by a gently curved surface. Therefore, drops of water adhering to the protruding portion 12 easily flow into the cutout portion 15 as illustrated by an arrow in the drawings.

Further, since an interval between the cutout portion 15 and the flange portion 13 is small, a drop of water W adhering to the base end of the flange portion 13 tends to enter the cutout portion 15. Furthermore, since the flange portion 13 is formed flat, it is difficult for the drop of water W adhering to this flange portion 13 to flow down onto the outer circumferential side of the flange portion 13.

Because of the above construction, when the rain cover 10 gets wet on a rainy day or when the car is washed, drops of water enter the ignition plug attaching hole 2 through the vent hole 16. Therefore, a high voltage current to be supplied to the ignition plug 3 leaks, so that the ignition plug can not be ignited.

SUMMARY OF THE INVENTION

The present invention has been achieved in view of the above problems. It is an object of the present invention to provide a rain cover in which drops of water do not easily enter the ignition plug attaching hole from the vent hole.

The above and other objects of the present invention can be accomplished by a rain cover of an ignition plug attaching hole of the present invention which comprises: a cover body engaged in an ignition plug attaching hole formed in an engine head, the cover body liquid-tightly sealing the ignition plug attaching hole; a vent hole formed in the cover body for communicating a space formed in the ignition plug attaching hole with the atmosphere; and a flange portion perpendicularly provided to the cover so that the flange portion comes into contact with an outer surface of the engine head, wherein a wall surface is perpendicularly provided on a surface of the cover body on the atmosphere side, the wall surface is opposed to a surface of the flange portion on the atmosphere side and extended outside in a radial direction being perpendicular to an axis of the ignition plug attaching hole, and an opening of the vent hole on the atmosphere side is closely disposed opposite the wall surface.

The opening of the vent hole on the atmosphere side faces a surface of the flange on the atmosphere side and further covered with a wall surface extending outward in the radial direction of the axis of the ignition plug attaching hole forming an acute angle with respect to this surface. Accordingly, it is possible easily and positively to prevent drops of water from entering the ignition plug attaching hole through the opening.

DETAILED DESCRIPTION OF THE PREFERRED EMBODIMENTS

With reference to the accompanying drawings, an example of the ignition cable connection terminal to which the present invention is applied will be explained as follows.

Figure 1:
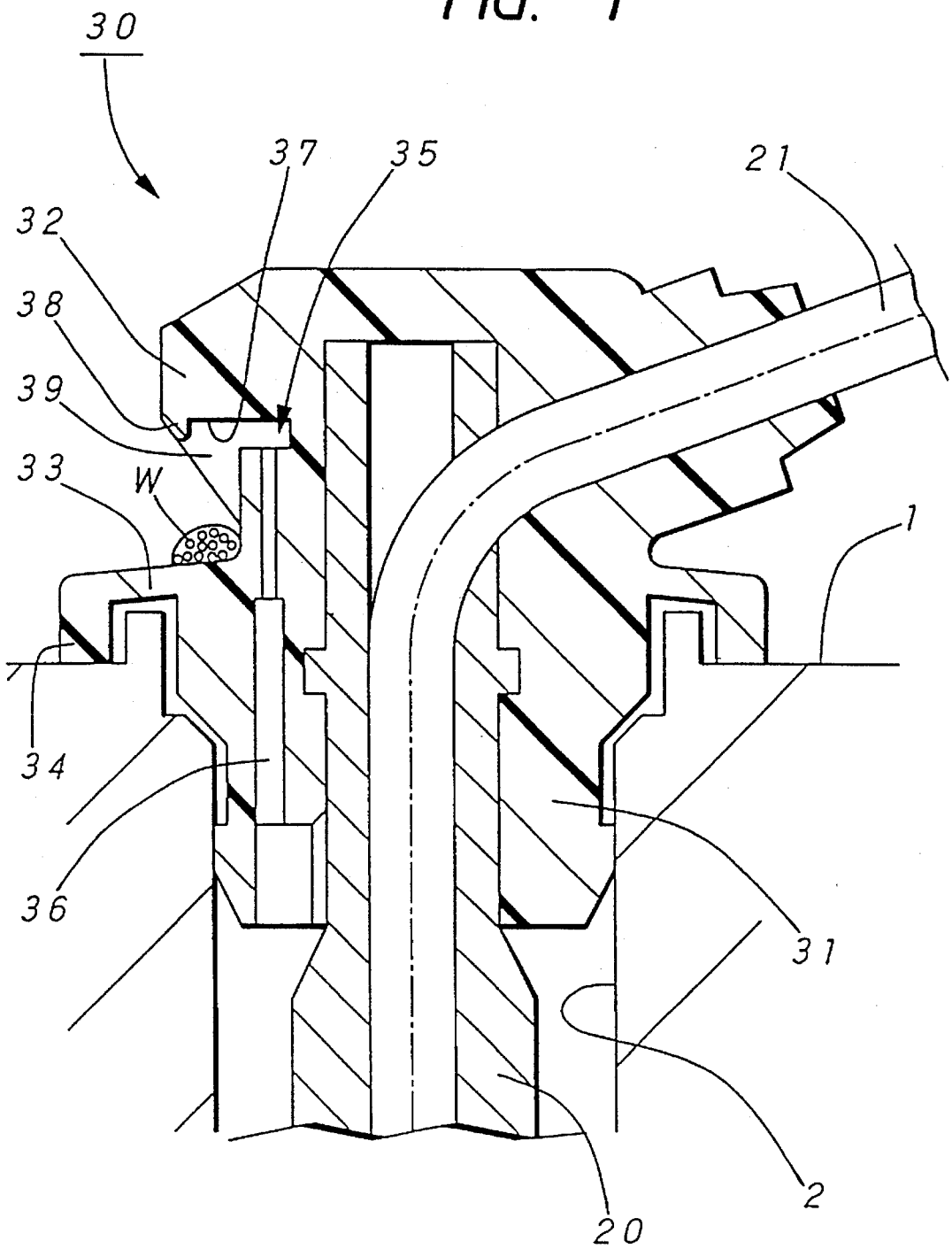
FIG. 1 is a sectional view of the example of the rain cover 1 of the ignition plug cap according to the present invention.

As shown in FIG. 1, the rain cover 30 is engaged in the ignition plug attaching hole 2 formed in the engine head 1 so that the ignition plug attaching hole 2 can be liquid-tightly sealed. The rain cover 30 is externally engaged with the insulator 20 and holds the high tension cable 21. The rain cover 30 includes: a cylindrical portion 31 forming the cover main body; a vent hole 36 formed through this cylindrical portion 31 so that air in the ignition plug attaching hole 2 can be communicated with the atmosphere; and a disk-shaped flange portion 33 having a contact portion 34 coming into contact with an outer surface of the engine head 1, wherein the disk-shaped flange portion 33 is concentrically provided on an outer circumferential surface of the cylindrical portion 31.

Further, a protruding portion 32 protruding outward in the radial direction with respect to an axis of the ignition plug attaching hole 2 is provided at a head of this rain cover 30. A lower surface 37 of this protruding portion 32 is extended in a direction perpendicular to the axis and opposed to the flange portion 33.

An opening of the vent hole 36 on the atmosphere side, communicating an inner space of the ignition plug attaching hole 2 with the atmosphere, is constructed in such a manner that it faces the cutout portion 35 provided in a base portion of this lower surface 37. The opening of the vent hole 36 on the atmosphere side is disposed close to the lower surface 37 so that it is opposite or facing the lower surface 37.

Due to the foregoing construction, even when the head of the rain cover 30 gets wet, drops of water do not easily reach and enter the ignition plug attaching hole 2 since the opening of the vent hole 36 on the atmosphere side is covered with the visor-shaped lower surface 37.

As shown in FIG. 1, a protrusion 38 for dripping water is perpendicularly provided at an outer end of the lower surface in such a manner that the protrusion 38 extends toward the flange portion 33. When the head of the rain cover 30 gets wet, drops of water flowing onto the lower surface 37 are blocked by the protrusion 38 for dripping water. Then the drops of water drop from the outer end to the flange 33, so that they are prevented from entering the vent hole 36.

Figure 2:
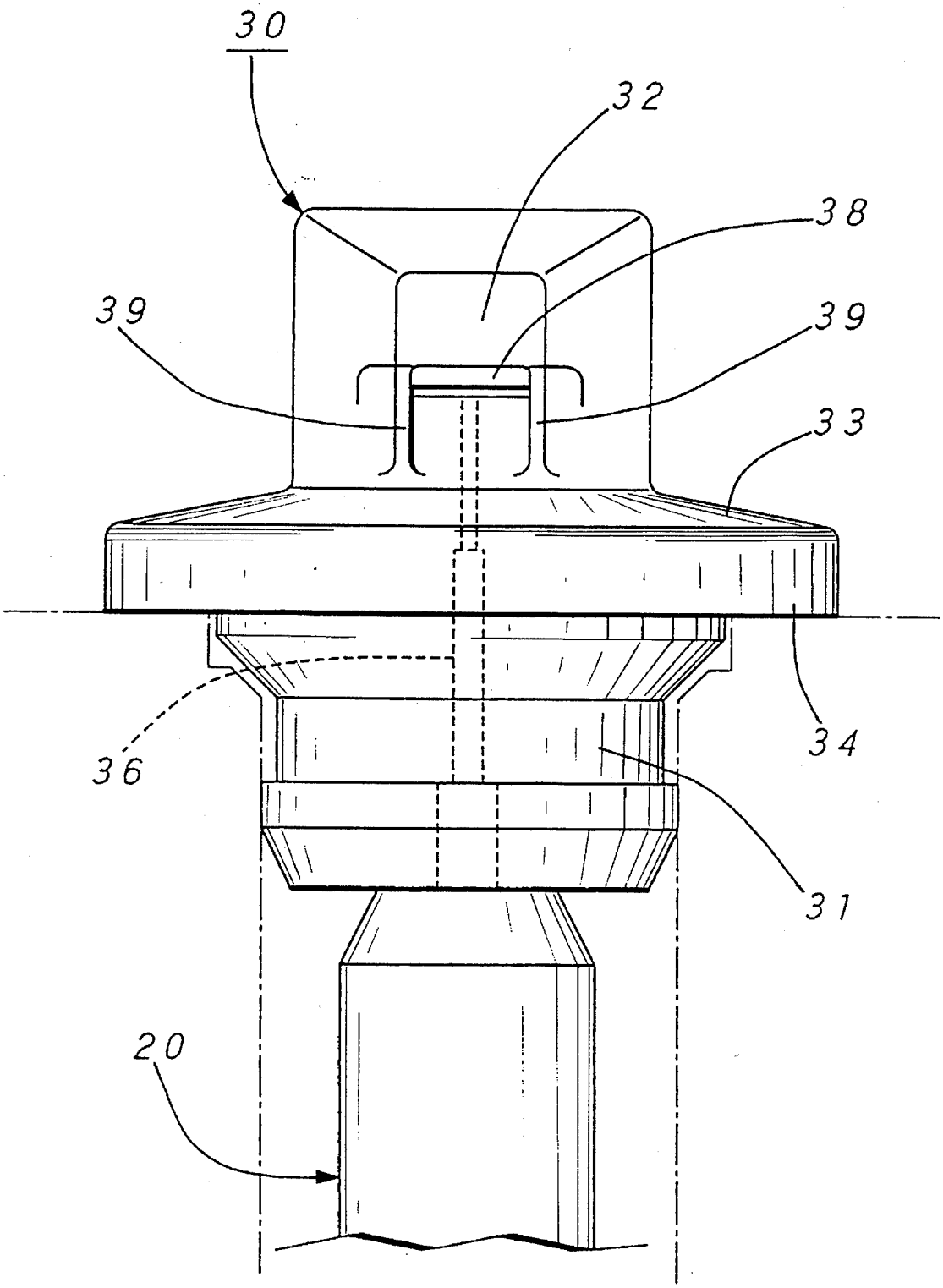
FIG. 2 is a front view of the rain cover shown in FIG. 1.
Figure 3:
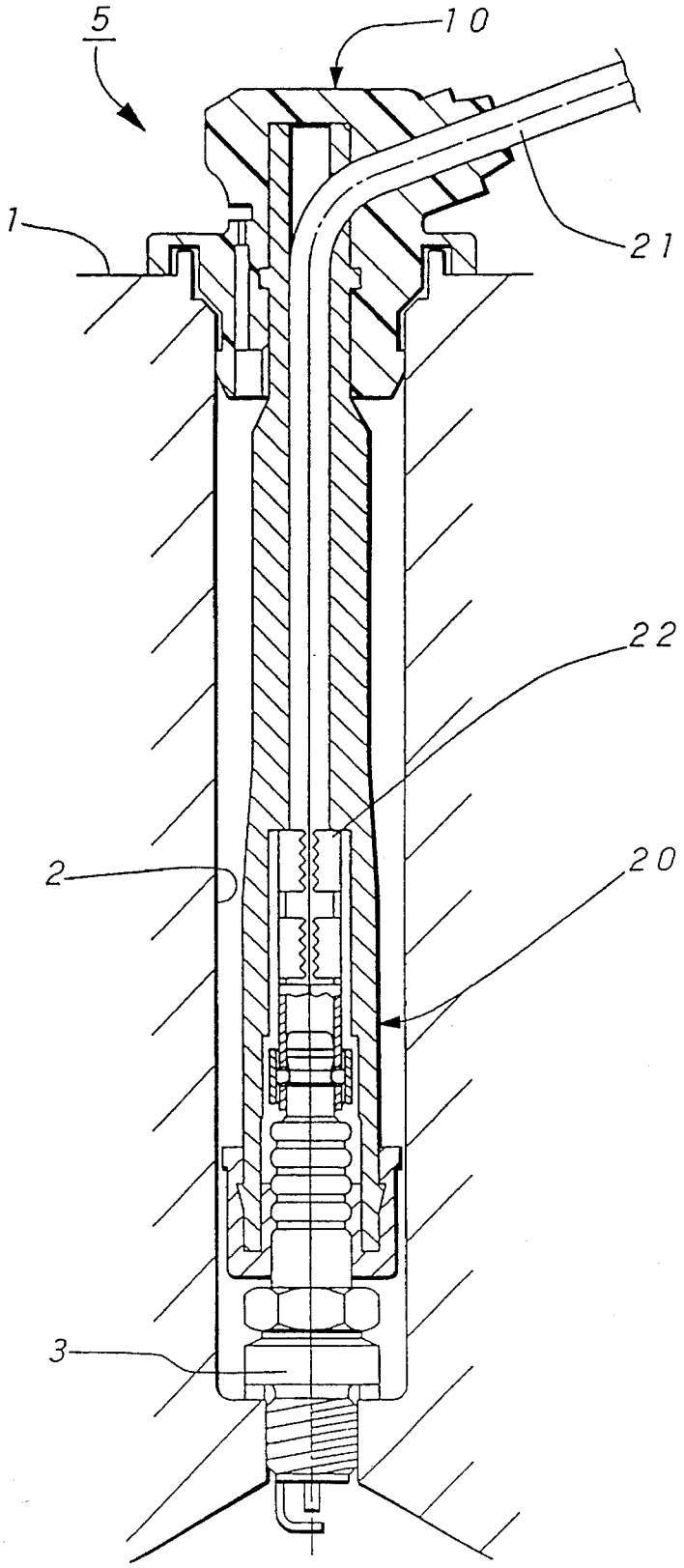
FIG. 3 PRIOR ART
FIG. 3 is a sectional view of the ignition plug cap provided with the conventional rain cover.

Further, as shown in FIGS. 1 and 2, a pair of longitudinal walls 39 perpendicular to the axis of the ignition plug attaching hole 2 are provided on the lower surface 37 in such a manner that the vent hole 36 is interposed between the pair of longitudinal walls 39, and the longitudinal walls 39 are perpendicularly provided toward the flange portion 33. As shown in FIG. 1, in the rain cover 30 of this example, these longitudinal walls 39 are triangular when they are viewed in a side direction, and the fore ends of these longitudinal walls 39 are extended toward a base end of the flange portion 33. Drops of water scattered from the side of the longitudinal wall 39 that would have hit the vent hole 36 are blocked by this longitudinal wall 39, so that the drops of water can be prevented from entering the vent hole 36.

Further, the pair of longitudinal walls 39 guide the drops of water adhering to the head and flowing onto the lower surface 37, onto the side of the flange portion 33 along the longitudinal wall 39. Therefore, the entrance of water to the vent hole 36 can be appropriately blocked. In addition, the longitudinal wall 39 prevents the twist of the protruding portion 32, so that the rigidity of the rain cover 30 can be enhanced.

Further, in the rain cover 30 of this example, an interval between the opening of the vent hole 36 and the surface of the flange portion 33 is set to be larger than the height of the drop of water W adhering to the base end of the flange portion 33. Due to the foregoing, the drop of water W can not easily reach the vent hole 36.

Moreover, when the upper surface of flange portion 33 is sloped downward away from the vent hole 36, the drop of water W adhering onto the surface of the flange portion 33 flows away from the vent hole 36.

Figure 4:
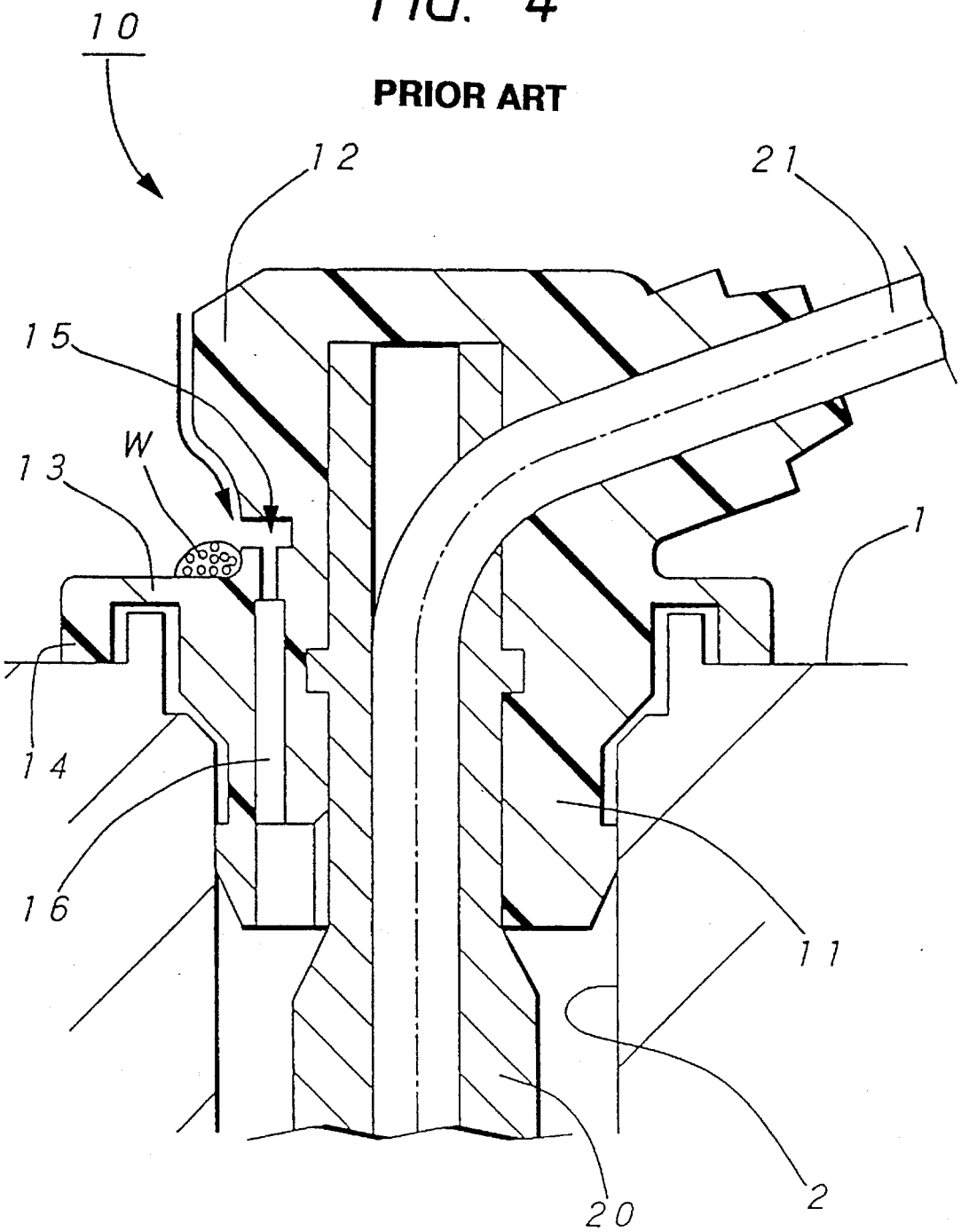
FIG. 4 PRIOR ART
FIG. 4 is a sectional view of the conventional rain cover.

Next, the water-proof characteristics of the rain cover 30 of this example shown in FIG. 1 and those of the conventional rain cover 10 shown in FIG. 4 are compared with reference to experimental results.

According to the results of an experiment in which 20 cc of water were dripped in one minute onto the head of the rain cover, not less than 1 cc of water entered the ignition plug attaching hole in the case of the conventional rain cover 10. On the other hand, in the case of the rain cover 30 of this example of the invention, water did not enter the ignition plug attaching hole at all.

In the same manner, according to the results of an experiment in which 140 cc of water was dripped onto the head of the rain cover in one minute, not less than 1 cc of water entered the ignition plug attaching hole in the case of the conventional rain cover 10. On the other hand, in the case of the rain cover 30 of this example of the invention, water did not enter the ignition plug attaching hole at all.

Further, according to the results of an experiment in which a large amount of water of 1200 cc per minute was scattered onto the head of the rain cover, not less than 1 cc of water entered the ignition plug attaching hole in the case of the conventional rain cover 10. On the other hand, in the case of the rain cover 30 of this example of the invention, an amount of water entering the ignition plug attaching hole was not more than 1 cc.

Consequently, according to the results of the above experiments, it was proved that the water-proof characteristics of the rain cover 30 of this example were greatly superior to those of the conventional rain cover 10. As the rain cover of the ignition cable attaching hole of the present invention is constructed in the manner described above, it is difficult for drops of water to enter the vent hole communicating the inner space of the ignition plug attaching hole with the atmosphere. Even when the rain cover gets wet when the car is driven in the rain or washed, drops of water do not enter the ignition plug attaching hole. Therefore, the conventional problem—a high voltage current supplied to the ignition plug leaks, so that the ignition plug is not ignited and the engine does not start or the engine revolution becomes out of order—is prevented.

What is claimed is:

1. A rain cover of an ignition plug attaching hole comprising:

a cover body fitted in an ignition plug attaching hole formed in an engine head, said cover body liquid-tightly sealing said ignition plug attaching hole;

a vent hole formed in said cover body for communicating a space formed in said ignition plug attaching hole with the atmosphere; and a flange portion perpendicularly provided to said cover body so that said flange portion comes into contact with an outer surface of said engine head, wherein a wall surface is perpendicularly provided on a surface of said cover body on the atmosphere side, said wall surface being opposed to a surface of said flange portion on the atmosphere side and extending outside in a radial direction perpendicular to an axis of said ignition plug attaching hole, and an opening of said vent hole on the atmosphere side is closely disposed facing said wall surface.

2. The rain cover of an ignition plug attaching hole according to claim 1, wherein a protrusion for dripping water is perpendicularly provided at an outer end of said wall surface.

3. The rain cover of an ignition plug attaching hole according to claim 2, further comprising a pair of longitudinal walls, extending in the circumferential direction, said opening being interposed between the pair of longitudinal walls, said longitudinal walls perpendicularly extending from said wall surface to said flange portion.

4. The rain cover of an ignition plug attaching hole according to claim 1, wherein an upper surface of said flange portion slopes downwardly away from said vent hole.

5. The rain cover of an ignition plug attaching hole according to claim 2, wherein an upper surface of said flange portion slopes downwardly away from said vent hole.

6. The rain cover of an ignition plug attaching hole according to claim 3, wherein an upper surface of said flange portion slopes downwardly away from said vent hole.

7. The rain cover of an ignition plug attaching hole according to claim 1, wherein an interval between the opening of said vent hole and an upper surface of said flange portion is larger than a height of a drop of water adhering to a base end of said flange portion.

8. The rain cover of an ignition plug attaching hole according to claim 2, wherein an interval between the opening of said vent hole and an upper surface of said flange portion is larger than a height of a drop of water adhering to a base end of said flange portion.

9. The rain cover of an ignition plug attaching hole according to claim 3, wherein an interval between the opening of said vent hole and an upper surface of said flange portion is larger than a height of a drop of water adhering to a base end of said flange portion.

* * * * *